US006491012B2

(12) United States Patent
Pryba et al.

(10) Patent No.: US 6,491,012 B2
(45) Date of Patent: Dec. 10, 2002

(54) ROCKER ARM ASSEMBLY HAVING A SPRING CLIP VALVE GUIDE

(75) Inventors: Stanley J. Pryba, Toledo, OH (US); Terry Shook, Sylvania, OH (US)

(73) Assignee: Toledo Technologies Inc., Perrysburg, OH (US)

( * ) Notice: Subject to any disclaimer, the term of this patent is extended or adjusted under 35 U.S.C. 154(b) by 0 days.

(21) Appl. No.: 09/952,008

(22) Filed: Sep. 11, 2001

(65) Prior Publication Data

US 2002/0046720 A1 Apr. 25, 2002

Related U.S. Application Data

(60) Provisional application No. 60/232,664, filed on Sep. 13, 2000.

(51) Int. Cl.[7] ..... F01L 1/18

(52) U.S. Cl. ..... 123/90.41; 123/90.39; 123/90.44; 123/90.65

(58) Field of Search ..... 123/90.39, 90.65, 123/90.44, 90.41; 140/82

(56) References Cited

U.S. PATENT DOCUMENTS

| | | | | |
|---|---|---|---|---|
| 1,644,750 A | | 10/1927 | Short | 123/90.47 |
| 3,139,872 A | * | 7/1964 | Thompson | 123/90.41 |
| 3,805,753 A | | 4/1974 | Bergmann et al. | 123/90.36 |
| 4,420,141 A | | 12/1983 | Goloff | 251/337 |
| 4,598,674 A | * | 7/1986 | Nono et al. | 123/90.41 |
| 5,529,033 A | | 6/1996 | Hampton | 123/90.16 |
| 5,619,958 A | | 4/1997 | Hampton et al. | 123/90.16 |
| 5,775,280 A | | 7/1998 | Schmidt et al. | 123/90.41 |
| 6,035,820 A | | 3/2000 | Engelhardt et al. | 123/90.41 |
| 6,047,675 A | | 4/2000 | Kunz | 123/90.41 |
| 6,062,184 A | | 5/2000 | Engelhardt et al. | 123/90.41 |

FOREIGN PATENT DOCUMENTS

| | | | |
|---|---|---|---|
| DE | 197 30 201 A1 | 7/1997 | F01L/1/18 |
| GB | 1386948 | 3/1975 | F01L/1/18 |

OTHER PUBLICATIONS

Danesh et al., Rocker Arm Assembly, US Patent PUblication No. US 2002/0017253 A1, Feb. 14, 2002.*

* cited by examiner

*Primary Examiner*—Thomas Denion
*Assistant Examiner*—Ching Chang
(74) *Attorney, Agent, or Firm*—Rader, Fishman & Grauer PLLC

(57) ABSTRACT

A rocker arm assembly having a main body with side walls and a push rod contacting portion spaced away from a valve stem contacting portion is disclosed. The valve stem contacting portion further includes a spring clip mounted thereon. The arms of the spring clip cooperate to form a channel for providing lateral guidance between the rocker arm and a valve stem.

27 Claims, 3 Drawing Sheets

ROCKER ARM ASSEMBLY HAVING A SPRING CLIP VALVE GUIDE

RELATED APPLICATIONS

This application claims the benefit of U.S. Provisional Application Ser. No. 60/232,664 filed Sep. 13, 2000 entitled "ROCKER ARM ASSEMBLY HAVING A SPRING CLIP VALVE GUIDE", hereby incorporated by reference in its entirety.

FIELD OF THE INVENTION

The present invention relates to a rocker arm having a valve guide to insure and operative connection between the valve guide and a valve pad of the valve guide, and more specifically, to a spring clip valve guide that permits relaxed manufacturing tolerances.

BACKGROUND OF THE INVENTION

In automotive internal combustion piston engines of the overhead camshaft type, it is known to provide a rocker arm assembly that cooperates with a lash adjuster having a cylindrical plunger and a finger follower that is pivotable about a pivot point during engine operation. To insure proper engagement between a lash adjuster and rocker arm assembly, it is known to provide a double walled end section formed by integral parallel straps that are bent 180° parallel to and in contact with a lower wall and welded thereto to provide two lateral seating surfaces. However, doubled walled end sections are disadvantageous because the double walled section results in a larger mass and consequently a greater amount of inertia for the lever. Moreover, additional manufacturing steps and increased production costs are required to fold and weld the straps to insure proper formation of the double walled sections.

It has also been known to provide a groove around a plunger for a lash adjuster to receive edges of a side-ways U-shaped retainer clip. A top portion of the side-ways U-shaped retainer clip engages an upwardly deformed rounded raised portion of the rocker arm with one arm curving around the upwardly deformed rounded raised portion. Another arm extends below a bottom surface of the rocker arm and engages the groove of the lash adjuster once the plunger is received in the upwardly deformed rounded raised portion of the rocker arm. However, while reducing weight, such arrangements are undesirable because the reduced diameter at the groove reduces the bending stiffness and strength of the plunger of the lash adjuster. Additional manufacturing costs are incurred for forming the upwardly deformed rounded raised portion. Moreover, tight tolerances must be maintained to insure that the spring clip properly engages both the lash adjuster and the upwardly deformed rounded raised portion.

Accordingly, there exists a need for a simplified construction for maintaining proper engagement between a lash adjuster and a rocker arm assembly that allows for an improved valve pad surface, relaxed tolerances for the valve tip and reduced reciprocating mass over the valve.

SUMMARY OF THE INVENTION

The present invention is directed to a rocker arm assembly pivotably mounted about a central roller that includes a main body section and first and second ends. In accordance with one aspect of the invention, the first end includes a detent into which a lash adjuster extending from the bore of the cylinder head is slidingly received. The second end includes apertures into which a distal end of a wire spring clip may be retainingly engaged. A cross member of the wire clip engages an outwardly extending land portion in a snap-fit relationship. When engaged, the wire spring clip forms two downwardly extending parallel arms that are spaced away from the bottom surface of the rocker arm. In accordance with the invention, a valve stem from a valve member may be positioned between the downwardly extending arms.

The wire spring clip advantageously provides additional contact points for consistent contact between the rocker arm assembly and the valve stem. The consistent contact allows for reduced machine tolerances of both the contact portion of the rocker arm and the valve stem tip during manufacture without sacrificing performance. Additionally, the consistent contact also provides an improved valve pad surface by allowing a smaller chamfer on the valve tip. Moreover, because the wire clip is relatively lightweight, reduced reciprocating mass over the valve is also achieved.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
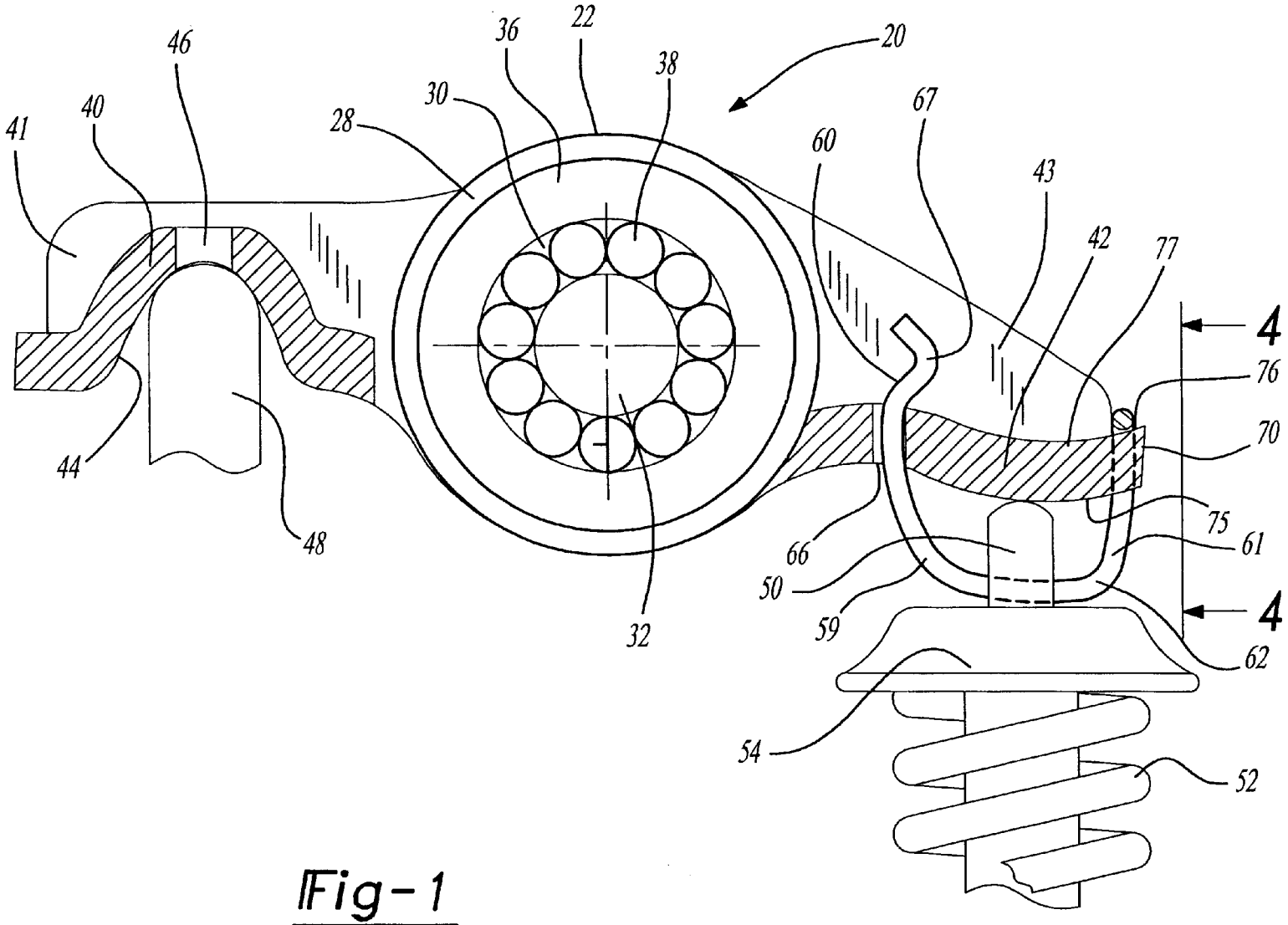
FIG. 1 is a partial cross-sectional view of a rocker arm assembly according to the present invention.
Figure 2:
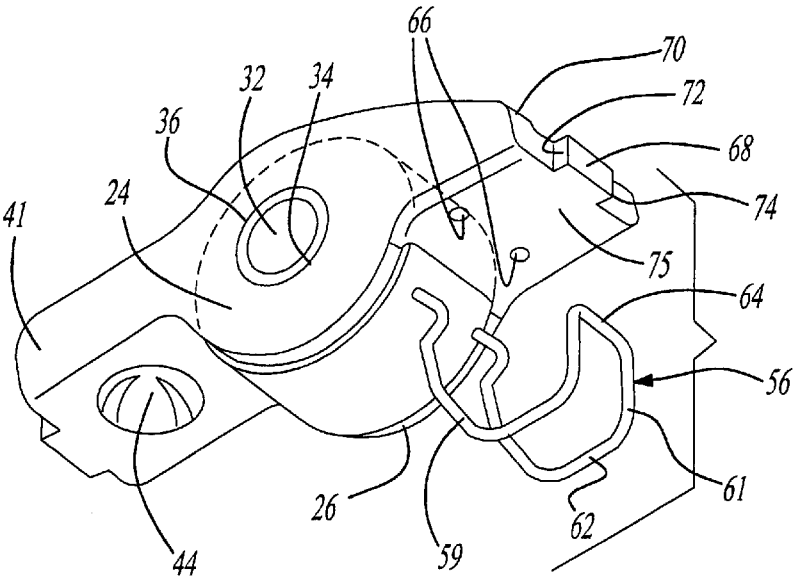
FIG. 2 is an exploded perspective view of a rocker arm and a spring clip prior to assembly.

FIGS. 1 and 2 show a rocker arm assembly 20 that includes a main rocker arm body 22 having first and second side walls 24, 26 projecting outwardly from a base 28. Base 28 includes a central cutout 30 to provide clearance for a cam follower roller 32. Apertures 34 are provided in the first and second side walls 24, 26 to mount a shaft 36, which supports bearings 38 and roller 32 for rotational movement.

Base 28 includes a push rod contacting portion 40 toward a first end 41 of main body 22 and a valve stem contacting portion 42 toward a second end 43 of main body 22.

Push rod contacting portion 40 includes a semi-spherical recess 44 that can optionally include a lubrication through hole 46 as shown in FIG. 1 to permit lubricant at the interface between the semi-spherical recess 44 and push rod 48. In addition, central cutout 30 generally separates push rod contacting portion 40 from valve stem contacting portion 42. Valve stem contacting portion 42 has a slightly convex shape in longitudinal cross-section as illustrated in FIG. 1. A valve stem 50 engages valve stem contacting portion 42 and has a valve spring 52 and a valve spring retainer 54 for controlling return movement of valve stem 50.

Further, in accordance with the present invention, a spring clip 56 is mounted adjacent to valve stem contacting portion 42 to provide lateral guidance of rocker arm assembly 20 relative to valve stem 50 during both installation and subsequent operation of rocker arm assembly 20. Preferably, spring clip 56 is formed from a single piece of wire that is generally round to eliminate burrs and provide a smooth surface for contacting valve stem 50 without interference. In addition, spring clip 56 is dimensioned to provide greater engagement length and depth for guidance relative to the valve stem than in prior known rocker arm devices, but with reduced weight. Spring clip 56 can be made from any suitable material and is preferably made from spring steel due to its durability and reduced weight.

Figure 3:
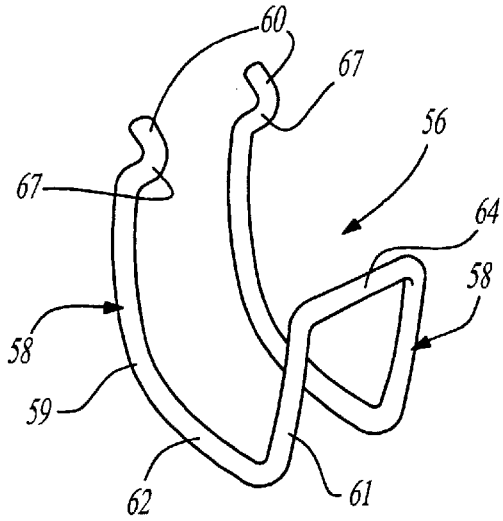
FIG. 3 is a perspective view of a spring clip according to the present invention for attachment to a rocker arm.

As shown more clearly in FIG. 3, spring clip 56 includes generally corresponding arms 58 that have a generally U-shaped cross-section. Arms 58 each include a curved portion 59 extending downwardly from distal ends 60. Curved portion 59 terminates in a generally flat bottom 62. Arms 58 each further include a generally linear portion 61 that extend upwardly from bottom 62. Ends 63 of linear portions 61 are joined together by a cross member 64. As will be explained in further detail below, curved portion 59 serves to provide spring characteristics to spring clip 56 during operation.

In accordance with the invention, as best shown in FIG. 2, valve stem contacting portion 42 of base 28 further includes apertures 66 that permit distal end 60 of spring clip 56 to pass upwardly therethrough. Preferably, distal ends 60 each include a deformed portion 67 that serves to prevent dislodgment of distal ends 60 from corresponding apertures 66. Deformed portions 67 may be formed prior to installing distal ends 60 in apertures 66, or formed after distal ends are inserted into apertures 66. Where deformed portions 67 are formed prior to installation, deformed portions 67 have a generally reverse S-shape such that spring clip 56 must be tilted in a rearward manner during installation such that linear portion 61 moves toward a center of base 28. Once deformed portions 67 are inserted into apertures 66, distal ends 60 are pushed upwardly and then spring clip 56 is tilted in a forward manner.

Valve stem contacting portion 42 of base 28 also includes a central projecting land portion 68 that projects outwardly from an end face 70 of valve stem contacting portion 42. As shown in FIG. 2, land portion 68 includes first and second sides 72, 74 that form shoulders where they meet end face 70. First and second sides 72, 74 are slightly tapered to slope outwardly toward a bottom surface 75 of valve stem contacting portion to be explained below in greater detail.

Figure 4:
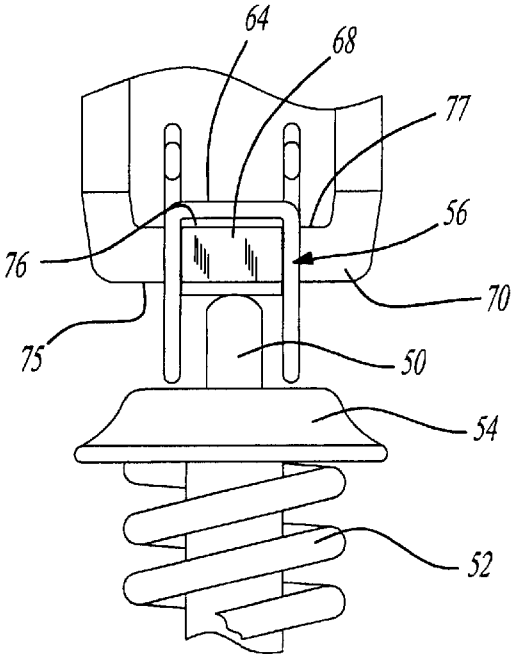
FIG. 4 is an end view of a rocker arm assembly taken along lines 4–4 of FIG. 1.

As shown in FIGS. 1 and 4, when mounted onto the valve stem contacting portion 42, distal ends 60 of spring wire clip 56 extend upwardly through base 28 with deformed portions 67 being positioned above a top surface 77 of base member 28. Cross member 64 is positioned over land portion 68 of end face 70 of the base 28 such that cross member 64 rests on top surface 76 of land portion 68. Cross member 64 is retained on land portion 68 by snap-fit engagement due to slightly tapered first and second sides 72, 74 of land portion 68 and the size of land portion 68 relative to the distance between arms 58. The distance between arms 58 and the length of cross member 64 generally correspond to the width of top surface 76 of land portion 68. Once spring clip 56 is connected to valve stem contacting portion 42, arms 58 extend downwardly such that bottom 62 is spaced from a bottom surface 75 of valve stem contacting portion 42 o form an elongated channel 78 having a predetermined depth, as best seen in FIG. 4. In accordance with the present invention, valve stem 50 is positioned between arms 58. Arms 58 provide lateral guidance between rocker arm 20 and valve stem 50, but allows for relaxed tolerances of bottom surface 75 of valve stem contacting portion 42 and the chamfer of valve stem 50.

In accordance with another aspect of the invention, curved portion 59 and linear portion 61 of arms 58 cooperate to provide spring like characteristics for spring clip 56 during operation of rocker arm assembly 20. Moreover, when spring clip 56 is installed on valve contacting portion 42, spring clip 56 is placed in tension, thereby preventing accidental removal of spring clip 56. However, it is understood that curved portion 59 of arms 56 in cooperation with liner portion 61 may be subjected to non-plastic tension or additional tension to unclip cross member 64 from land portion 68.

Figure 5:
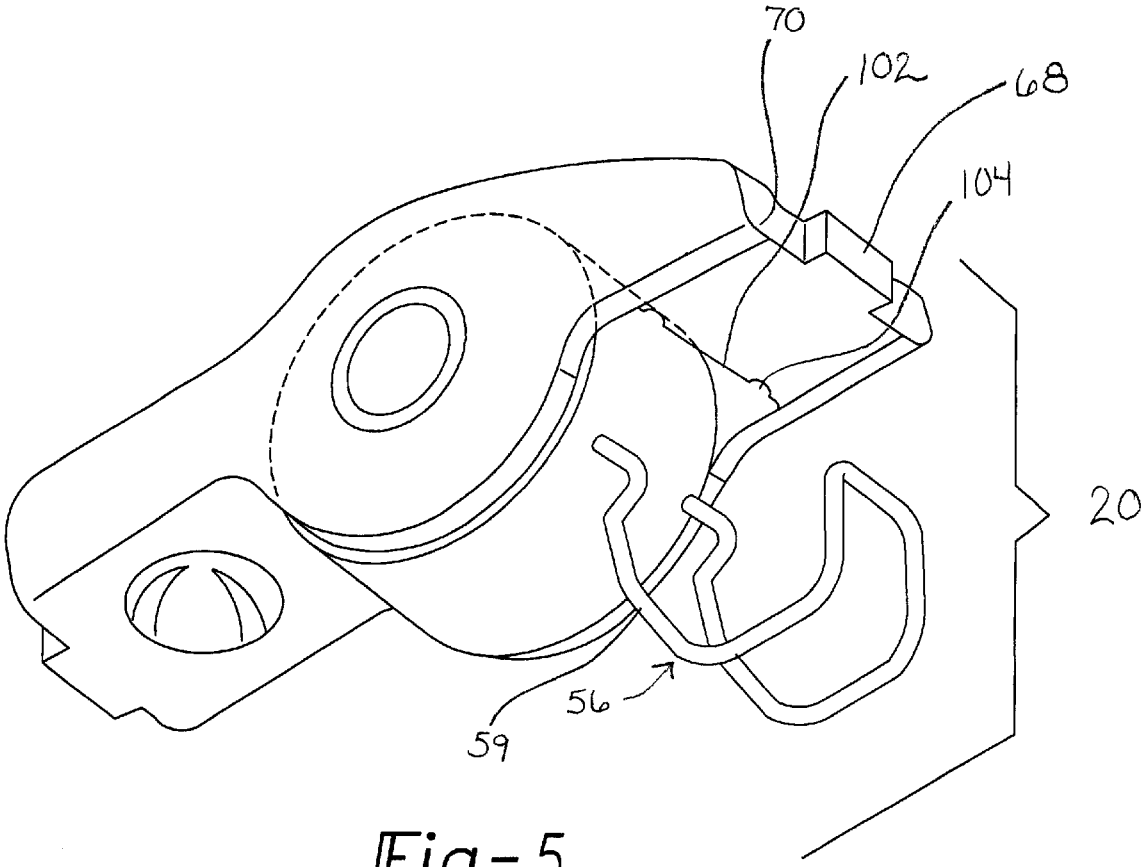
FIG. 5 is a perspective view of an alternative embodiment of a rocker arm in accordance with the present invention.

An alternative embodiment of the present invention is shown in FIG. 5. Instead of apertures 66, a cutout section 100 for cam roller 32 is longer at valve stem contacting portion 42. A second central projecting land portion 102 is formed on valve stem contacting portion 42 adjacent to cam roller 32 on the side opposite of end face 70. Second central projecting land portion 102 is formed by cooperating inwardly extending grooves 104. Grooves 104 are generally the size and shape of spring clip 56 to insure a snap fit engagement. Second central projecting land portion 102 serves to space arms 58 apart. It is understood that grooves 104 may have alternative cross-sections that are sized to capture curved portion 59 of arms 58.

To connect spring clip 56 to valve stem contacting portion 42, distal ends 66 are engaged with grooves 104 and second central projecting land portion 102. Cross member 64 is then engaged with first central projecting land portion 68.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A rocker arm assembly for use in an internal combustion engine comprising:

a main body having side walls and first and second ends;

wherein said first end includes a push rod contacting portion, said second end having a valve stem contacting portion;

a cam follower roller mounted between said side walls intermediate said push rod contacting portion and said valve stem contacting portion;

at least one aperture located in said valve stem contacting portion;

a spring clip mounted on said valve stem contacting portion for providing lateral guidance between said rocker arm and a valve stem, wherein said spring clip includes at least one distal end for engaging said aperture in said valve stem contacting portion.

2. The rocker arm assembly of claim 1, wherein said spring clip is formed from a single segment of wire.

3. The rocker arm assembly of claim 1, wherein said spring clip includes two substantially corresponding and generally U-shaped arms that extend downwardly from said at least one distal end to form a generally flat bottom and extend upwardly from said bottom.

4. The rocker arm assembly of claim 3, wherein said arms include a curved portion and a substantially linear portion, wherein said curved portion and said linear portion are separated by said bottom and ends of said linear portion are joined by a cross member.

5. The rocker arm assembly of claim 4, wherein said curved portion extends downwardly from said distal end and has a generally concave shape.

6. The rocker arm assembly of claim 3, wherein each of said distal ends includes a deformed portion to resist disassembly of said distal end through said aperture.

7. The rocker arm assembly of claim 6, wherein said deformed portions are formed after said distal end is received through said apertures.

8. The rocker arm assembly of claim 3, further comprising a land portion projecting from an end face of said second end for supporting said cross member of said spring clip.

9. The rocker arm assembly of claim 8, wherein said land portion has sides that are slightly tapered outwardly in a downward direction toward a bottom surface of said second end to resist removal of said lateral cross member of said spring clip.

10. The rocker arm assembly of claim 8, wherein said land portion has a width approximately the same as a distance between said downwardly extending arms of said spring clip.

11. The rocker arm assembly of claim 10, wherein said curved portion, bottom and linear portion cooperate to create compressive forces on said spring clip in a non-installed unbiased state such that when installed on said valve stem contacting portion, spring clip will not become accidentally dislodged.

12. The rocker arm assembly of claim 1, wherein said at least one distal end extends through said apertures and is positioned at a level above said cross member of said spring clip.

13. The rocker arm assembly of claim 1, wherein said spring clip includes a second distal end for engaging an outer portion of said valve stem contacting portion.

14. The rocker arm assembly of claim 1, wherein said spring clip is compressible in response to valve stem movement.

15. A rocker arm assembly for use in an internal combustion engine comprising:

a main body having side walls and first and second ends spaced away from one another;

wherein said first end includes a push rod contacting portion and said second end includes a valve stem contacting portion;

a cam follower roller mounted between said side walls intermediate said push rod contacting portion and said valve stem contacting portion;

a land portion projecting outwardly from an end face of said valve stem contacting portion of said base;

mounting apertures extending through said valve stem contacting portion inboard of said end face;

a spring clip having a generally U-shaped cross-section, said spring clip mounted to said valve stem contacting portion for providing lateral guidance between said rocker arm and a valve stem, wherein said spring clip includes a pair of arms having distal ends extending upwardly through said apertures and a cross member that connects said arms, said cross-member engagable with said land portion.

16. The rocker arm assembly of claim 15, wherein said arms include a curved portion and a substantially linear portion, wherein said curved portion and said linear portion are separated by a bottom such that said curved portion extends downwardly from said distal ends and ends of said linear portion are joined by a cross member.

17. The rocker arm assembly of claim 15, wherein said distal ends each further include deformed portions to resist disassembly of said distal end through said aperture once said spring clip is engaged to said valve stem contacting portion.

18. The rocker arm assembly of claim 15, wherein said land portion includes first and second sides that are slightly tapered downwardly toward a bottom surface of said end face to resist removal of said cross member of said spring clip when said spring clip is engaged with said land portion.

19. The rocker arm assembly of claim 15, wherein said spring clip further includes a bottom portion that is spaced away from a bottom surface of said valve stem contacting portion when said spring clip is connected to said valve stem contacting portion.

20. The rocker arm assembly of claim 19, wherein said pair of arms cooperate to form a lateral channel into which a valve stem is received.

21. The rocker arm assembly of claim 17, wherein a top surface of said land portion has a width that is generally the same as a distance between said arms of said spring clip to place said spring clip in tension when mounted on said valve stem contacting portion to resist accidental dislodgment of said spring clip from said rocker arm.

22. A spring clip for use in connection with a valve stem contacting portion of a rocker arm, comprising a pair of generally corresponding arms, wherein each of said arms includes:

a curved portion extending downwardly from a first distal end, wherein said curved portion has a generally concave shape;

a generally flat bottom section extending laterally away from said curved portion; and a substantially linear section extending upwardly from said bottom section such that said bottom section is positioned between said curved portion and said linear section, said linear section terminating in second distal ends; and each of said arms connected together at said second distal ends by a cross member;

wherein said curved portion, bottom section and linear section cooperate to provide a predetermined compressibility and said first distal ends and said cross member are receivable on a valve stem contacting portion of a rocker arm to provide lateral guidance for a valve stem.

23. A rocker arm assembly for use in an internal combustion engine comprising:

a main body having side walls and first and second ends;

wherein said first end includes a push rod contacting portion, said second end having a valve stem contacting portion;

a cam follower roller mounted between said side walls intermediate said push rod contacting portion and said valve stem contacting portion;

at least one groove formed in said valve stem contacting portion;

a spring clip mounted on said valve stem contacting portion for providing lateral guidance between said rocker arm and a valve stem, wherein said spring clip includes at least one distal end for engaging said groove in said valve stem contacting portion.

24. The rocker arm assembly of claim 23, wherein said spring clip includes two substantially corresponding and generally U-shaped arms that extend downwardly from said at least one distal end to form a generally flat bottom and extend upwardly from said bottom.

25. The rocker arm assembly of claim 24, wherein said arms include a curved portion and a substantially linear portion, wherein said curved portion and said linear portion are separated by said bottom and ends of said linear portion are joined by a cross member.

26. The rocker arm assembly of claim 24, further comprising a first land portion projecting from an end face of said second end for supporting said cross member of said spring clip.

27. The rocker arm assembly of claim 26, further comprising two grooves extending inwardly on a side opposite of said end face of said second end, wherein said grooves form a second land portion projecting from said send end, wherein said arms are receivable within said grooves.

* * * * *